US009427805B2

(12) United States Patent
Rowe et al.

(10) Patent No.: US 9,427,805 B2
(45) **Date of Patent: *Aug. 30, 2016**

(54) METHOD TO PREPARE HARD-SOFT MAGNETIC FECO/ SIO2/MNBI NANOPARTICLES WITH MAGNETICALLY INDUCED MORPHOLOGY

(71) Applicant: Toyota Motor Engineering & Manufacturing North America, Inc., Erlanger, KY (US)

(72) Inventors: Michael Paul Rowe, Pinckney, MI (US); Ryan Daniel Desautels, Winnipeg (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/270,752

(22) Filed: May 6, 2014

(65) Prior Publication Data

US 2015/0325347 A1 Nov. 12, 2015

(51) Int. Cl.

| | |
|---|---|
| ***H01F 7/02*** | (2006.01) |
| ***B22F 1/02*** | (2006.01) |
| ***H01F 1/01*** | (2006.01) |
| ***H01F 41/24*** | (2006.01) |
| ***B22F 9/24*** | (2006.01) |
| ***B22F 1/00*** | (2006.01) |
| ***H01F 1/00*** | (2006.01) |

(52) U.S. Cl.

CPC ..... *B22F 1/02* (2013.01); *B22F 1/0018* (2013.01); *B22F 9/24* (2013.01); *H01F 1/0054* (2013.01); *H01F 1/01* (2013.01); *H01F 41/24* (2013.01); *B22F 2999/00* (2013.01)

(58) Field of Classification Search

CPC ..... H01F 1/01; H01F 41/24; H01F 7/02
USPC ..... 75/351; 427/127, 128, 129, 130, 131, 427/132, 547, 598; 977/773, 902, 838; 428/842.4, 842.6, 842.1

See application file for complete search history.

(56) References Cited

U.S. PATENT DOCUMENTS

| | | | | |
|---|---|---|---|---|
| 2005/0061785 | A1* | 3/2005 | Schroder | B01J 19/088 219/121.56 |
| 2013/0342069 | A1 | 12/2013 | Rowe | |
| 2014/0027667 | A1 | 1/2014 | Rowe | |
| 2014/0035713 | A1 | 2/2014 | Rowe | |
| 2015/0068646 | A1* | 3/2015 | Rowe | B22F 1/0018 148/300 |
| 2015/0325346 | A1* | 11/2015 | Rowe | H01F 1/01 252/62.55 |

OTHER PUBLICATIONS http://cmrr.ucsd.edu/people/berkowitz/documents/1133257.pdf, Jun. 5, 2014.*
U.S. Appl. No. 14/296,917, filed Jun. 5, 2014, Rowe, et al.
U.S. Appl. No. 13/942,116, filed Jul. 15, 2013, Rowe, et al.
U.S. Appl. No. 13/921,878, filed Jun. 19, 2013, Rowe.
(Continued)

*Primary Examiner* — Michael Cleveland
*Assistant Examiner* — Tabassom Tadayyon Eslami
(74) *Attorney, Agent, or Firm* — Oblon, McClelland, Maier & Neustadt, L.L.P.

(57) ABSTRACT

A method to prepare a core-shell-shell $FeCo/SiO_2/MnBi$ nanoparticle wherein the morphology of the MnBi shell is formed by synthesis of the MnBi layer in an applied magnetic field is provided.

8 Claims, 3 Drawing Sheets

(56) References Cited

OTHER PUBLICATIONS

U.S. Appl. No. 13/900,860, filed May 23, 2013, Rowe.
U.S. Appl. No. 14/025,033, filed Sep. 12, 2013, Rowe.
U.S. Appl. No. 14/252,036, filed Apr. 14, 2014, Rowe, et al.
U.S. Appl. No. 14/270,619, filed May 6, 2014, Rowe, et al.
Office Action issued Sep. 3, 2015 in German Patent Application No. 10 2015 107 049.9.
U.S. Appl. No. 14/521,063, filed Oct. 22, 2014, Rowe, et al.

* cited by examiner

METHOD TO PREPARE HARD-SOFT MAGNETIC FECO/ SIO2/MNBI NANOPARTICLES WITH MAGNETICALLY INDUCED MORPHOLOGY

BACKGROUND OF THE INVENTION

1. Field of the Invention

The present invention relates to method to prepare a magnetic core-shell-shell nanoparticles having an iron cobalt alloy core, an intermediate silica shell and a manganese bismuth alloy surface layer on the silica shell having altered morphology obtained by nanoparticle synthesis within an applied magnetic field. This method offers further opportunity to prepare magnetic nanoparticles that may be tuned to have specific properties and thus provide a nanoparticle material suitable for preparation of a permanent magnet that is a rare-earth-element-free alternative to the standard neodymium iron borate permanent magnet material.

2. Discussion of the Background

The inventors are conducting a research program investigating both soft and hard magnetic materials obtained with nanoparticle materials obtained from wet chemical synthetic processes. Thus U.S. application Ser. No. 14/025,033, filed Sep. 12, 2013, discloses MnBi nanoparticles having a particle size of 5 to 200 nm as a source for hard magnetic materials. Additionally, U.S. Ser. No. 14/252,036, filed Apr. 14, 2014, discloses core-shell nanoparticles having an iron cobalt nanoparticle core of less than 200 nm with a silica shell and metal silicate interface as a source for soft magnetic materials. The disclosures of both Applications are incorporated herein by reference in their entireties. Further, in U.S. application Ser. No. 14/270,619, filed May 6, 2014, the inventors have disclosed core-shell-shell nanoparticles having a soft magnetic nanoparticle core of an iron cobalt alloy, a first shell of silica on the core and a further hard magnetic nano-coating of a manganese bismuth alloy. U.S. application Ser. No. 14/270,619 is incorporated herein by reference in its entirety.

Magnetic materials generally fall into two classes which are designated as magnetically hard substances which may be permanently magnetized or soft magnetic materials which may be reversed in magnetism at low applied fields. It is important in soft magnetic materials that energy loss, normally referenced as "core loss" is kept to a minimum whereas in hard magnetic materials it is preferred to resist changes in magnetization. High core losses are therefore characteristic of permanent magnetic materials and are undesirable in soft magnetic materials.

Many of today's advancing technologies require an efficient and strong hard magnet as a basic component of the device structure. Such devices range from cellular phones to high performance electric motors and significant effort is ongoing throughout the industry to find materials which not only meet current requirements, but also ever increasing demand for efficient, less expensive and easily produced hard magnet materials.

Conventionally, neodymium iron borate is generally recognized as one of the strongest, best performing hard magnet materials available. However, because this material is based on the rare earth element neodymium, it is expensive and often the available supply is not stable. Accordingly, there is a need for a material which performs equally or better than neodymium iron borate as a hard magnet but which is based on readily available and less expensive component materials.

Magnetic device parts are constructed from powders by compaction of the powders to a defined shape and then sintering the compact at temperatures of 200° C. or higher. Sintering the part following compaction, is necessary to achieve satisfactory mechanical properties in the part by providing particle to particle bonding and hence strength.

Technological advances in all aspects of the communications and power generation fields require ever increasing powerful magnetic powders having controllable or tunable magnetic properties which allow for production of tailored magnetic parts that are economical and readily obtainable.

Thus, an object of the present invention is to provide a method for preparing nanoparticle powders having magnetic properties that are tunable according to the controllable variable of the method.

SUMMARY OF THE INVENTION

This and other objects have been achieved according to the present invention, the first embodiment of which includes a method to prepare a core-shell-shell $FeCo/SiO_2/MnBi$ nanoparticle, comprising:

a) co-reducing an iron ion and a cobalt ion from a common solution; and coprecipitating an FeCo alloy nanoparticle;

isolating the FeCo nanoparticle from the reduction mixture;

b) forming a silica coating on the FeCo nanoparticle to obtain a core-shell nanoparticle; and c) forming a MnBi alloy nanocoating on the core-shell nanoparticle by reduction of Bi with a Mn-reagent for the precipitation from a solution as a MnBi alloy onto the silica shell wherein the formation of the MnBi alloy nanocoating c) is conducted within a magnetic field of from 50 to 800 Gauss.

In another embodiment, the present invention includes the core-shell-shell nanoparticle obtained according to the method of the first embodiment.

In an aspect of this embodiment the width of the MnBi coating may be from 0.5 to 200 nm.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE INVENTION

Figure 1:
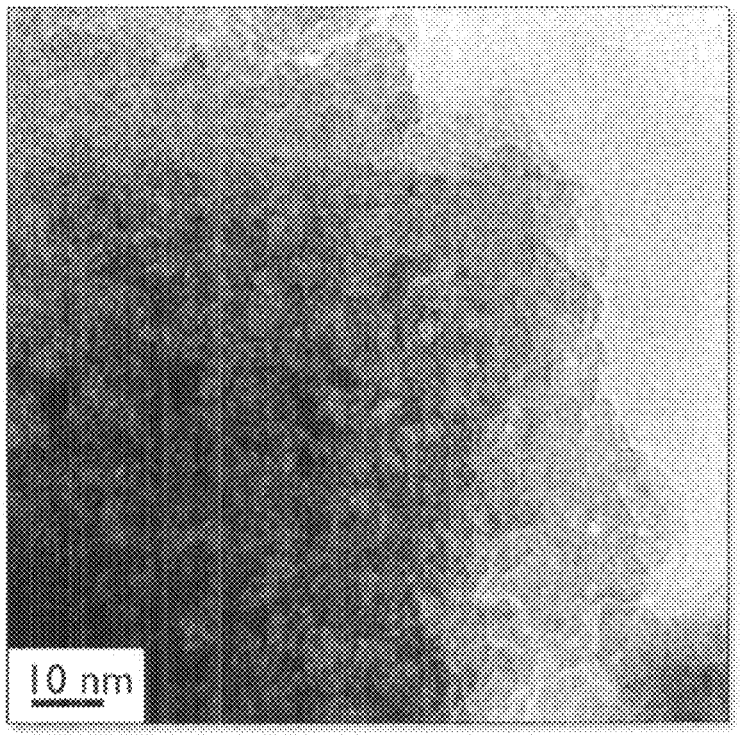
FIG. 1 shows a TEM image of the core-shell-shell nanoparticles prepared in the Example.

Throughout this description all ranges described include all values and sub-ranges therein, unless otherwise specified.

Additionally, the indefinite article "a" or "an" carries the meaning of "one or more" throughout the description, unless otherwise specified.

In an ongoing study of magnetic materials and particularly nanoparticle magnetic materials, the present inventor has identified manganese bismuth alloy in a nanoparticle form as a material having potential utility as a replacement of neodymium iron borate for manufacture of permanent magnets. MnBi nanoparticles were predicted to express coercivities as high as 4 T. The invention disclosed in U.S. application Ser. No. 14/025,033, filed Sep. 12, 2013, discloses some results of that work.

The inventors are also conducting ongoing studies with soft magnetic nanoparticle materials such as disclosed in U.S. Ser. No. 14/252,036, filed Apr. 14, 2014, wherein core-shell nanoparticles having an iron cobalt nanoparticle core of less than 200 nm with a silica shell and metal silicate interface are disclosed.

In ongoing research with these and other systems, the inventors have surprisingly discovered core-shell-shell nanoparticles obtained by application of a manganese bismuth nanocoating to a FeCo alloy core silica coating core-shell nanoparticle provides a material having highly tunable magnetic properties according to the relative size and nature of each of the core-shell-shell components. Such a complex combination of soft and hard magnetic components within one nanoparticle is novel and offers many opportunities for discovery and development of new magnetic materials and devices.

In a first embodiment, the present invention includes a method to prepare a core-shell-shell $FeCo/SiO_2/MnBi$ nanoparticle, comprising:

a) co-reducing an iron ion and a cobalt ion from a common solution; and coprecipitating an FeCo alloy nanoparticle;

isolating the FeCo nanoparticle from the reduction mixture;

b) forming a silica coating on the FeCo nanoparticle to obtain a core-shell nanoparticle; and c) forming a MnBi alloy nanocoating on the core-shell nanoparticle by reduction of Bi with a Mn-reagent for the precipitation from a solution as a MnBi alloy onto the silica shell; wherein the formation of the MnBi alloy nanocoating c) is conducted within a magnetic field of from 50 to 800 Gauss.

The inventors have discovered that the formation of individual FeCo alloy nanoparticles coated with silica shells of various thicknesses may be achieved via a scalable wet chemical process. Surprisingly, the inventors have discovered that formation of interfacial metal silicates may alter significantly the nanomagnetism in these ultra-high surface area FeCo alloy nanoparticle systems. Evidence that an interfacial layer of metal silicates had formed was observed in x-ray photoelectron spectra collected over the 2p transitions of Fe and Co; and as the thickness of the silica shell was increased (by altering the duration of the silica reaction) a thicker interfacial metal silicate layer was formed, increasing the nanoparticles' overall magnetic anisotropy, as evidenced by increased blocking temperatures and altered coercivities. Thus the inventors have surprisingly discovered that by producing superparamagnetic iron cobalt alloy nanoparticles that are encapsulated in silica shells with varying degree of wet synthesis treatment time, core shell FeCo nanoparticles having differing nanomagnetic properties may be obtained. In certain embodiments the diameter of the iron cobalt alloy nanoparticle core is 100 nm or less, and in further embodiments the diameter of the iron cobalt alloy nanoparticle core is from 2 nm to 50 nm.

According to the invention, the iron cobalt alloy nanoparticle grains are of or approaching the size of the single particle magnetic domain of the iron cobalt alloy and thus are superparamagnetic. While not being constrained to theory, the inventors believe control of grain size to approximately that of the particle magnetic domain is a factor which contributes to the reduced hysteresis of a magnetic core according to the present invention. Moreover, the presence of insulating silica shells about the core grains is a factor which contributes to the low eddy current formation of a magnetic core according to the present invention.

It is conventionally known that the range of particle size for which single domain particles exhibit superparamagnetism has an upper boundary characteristic of the particle chemical composition.

The inventors have discovered that during synthesis of the silicon dioxide shell a metal silicate thin layer interface is coincidentally formed. Evidence that an interfacial layer of metal silicates had formed was observed in x-ray photoelectron spectra collected over the 2p transitions of Fe and Co; and as the thickness of the silica shell was increased (by altering the duration of the silica reaction) a thicker interfacial metal silicate layer was formed, increasing the nanoparticles' overall magnetic anisotropy, as evidenced by increased blocking temperatures and altered coercivities. The inventors have recognized that an understanding of the effect of this interfacial metal silicate layer to control magnetic properties is a key element to effective utility of these materials in applications as low-loss transformer cores.

In a study of the FeCo alloy core shell nanoparticles, the inventors have discovered that interfacial metal silicates formed during the silicon dioxide shell coating synthesis, alter the overall magnetic anisotropy of the nanoparticles as a higher anisotropy phase that is a combination of Fe- and Co-based silicates that acts to increase the 'magnetically active volume' of the nanoparticles compared to a bare FeCo nanoparticle.

Binary alloy FeCo single-magnetic-domain nanoparticle samples were synthesized (see Example), with the exception of varying the duration of the $SiO_2$ reaction times, which led to $SiO_2$ shells of varying thickness: a 1 min reaction time produced a 3 nm thick shell, 10 minutes a 4 nm thick shell, and 20 minutes a 6 nm thick shell. The average FeCo nanoparticle diameter and $SiO_2$ shell thickness were determined and for all three core/shell nanoparticle samples ($FeCo/SiO_2$ (3 nm), $FeCo/SiO_2$ (4 nm), and $FeCo/SiO_2$ (6 nm)), the average FeCo core diameter was found to be 4±1 nm indicating a high degree of reproducibility in the nanoparticle core synthesis. The thicknesses of the silica shells were determined in a similar manner and found to be 3±1 nm, 4±1 nm, and 6±1 nm for the $FeCo/SiO_2$ (3 nm), $FeCo/SiO_2$ (4 nm), and $FeCo/SiO_2$ (6 nm) samples, respectively. From the TEM images, it was observed that the FeCo cores were covered completely by the silica shells. Analysis of X-ray diffraction patterns indicated the presence of both Fe and Co silicates. However, the relative proportions appear to be variable and although not wishing to be constrained by theory, the inventors believe that metal silicate content may be related to the thermodynamic energy of formation of the metal silicate. The studies showed that Fe- and Co-silicates formed at the interface between the FeCo nanoparticle core and the $SiO_2$ shell during the synthesis process. However, the relative integrated areas of the $Fe^0$ and $Co^0$ metallic peaks of the different core/shell nanoparticle systems indicated Fe-silicates may be formed preferentially over Co-silicates.

Nanoparticles of Fe—Co/$SiO_2$ may be synthesized by the ethanolic reaction of sodium borohydride with iron dichloride and cobalt dichloride in a solution of sodium hydroxide and tetraoctylammonium bromide. The obtained nanoparticles may be treated with tetraethyl orthosilicate, in water ethanol mixture using triethylamine as the base-catalyst, to form silica shells. These particles may then be purified using an aqueous ethanol rinse.

As indicated, the length of the treatment of the Fe—Co nanoparticles determines the width of the silicon dioxide coating and correspondingly, the width of the metal silicate layer. The longer the treatment time, the greater the amount of the coating and the greater the width of the metal silicate layer.

The synthesis may be conducted for such time as necessary to prepare a metal silicate layer of 0.5 to 20 nm, preferably 0.8 to 10 nm and most preferably 1.0 to 8 nm.

According to the invention the manganese-bismuth coating is formed on the FeCo silica core shell nanoparticle under the influence of an applied magnetic field. The strength of the magnetic field may be from 10 to 1000 Gauss, preferably 25 to 900 gauss and most preferably 50 to 800 Gauss. The source of the magnetic field is not limited and may be formed, for example, by placing the reaction mixture next to one permanent magnet, adjacent to an electromagnet, between two permanent magnets or by placing the reaction mixture within a solenoid.

The manganese-bismuth alloy coating may be formed by a method comprising in the presence of the FeCo silica core shell nanoparticles, ball milling Mn powder with a hydride reducing agent; adding a solution of a bismuth salt of a long chain carboxylate and an alkyl amine to the Mn-hydride reducing agent in an ether solvent with agitation; upon completion of the bismuth salt solution addition; and continuing agitation to form the core-shell-shell FeCo/$SiO_2$/MnBi nanoparticles.

The ether solvent for the hydride treatment may be any ether compatible with hydride reaction conditions. Suitable ether solvents include tetrahydrofuran (THF), 2-methyltetrahydrofuran, diethyl ether, diisopropyl ether, 1,4-dioxane, dimethoxy ethane, diethylene glycol diethylether, 2-(2-methoxyethoxyl)ethanol and methyl tert-butyl ether. THF may be a preferred solvent.

The hydride reducing agent may be any material capable of reacting with the manganese and include NaH, LiH, $CaH_2$, $LiAlH_4$ and $LiBH_4$. $LiBH_4$ may be a preferred hydride treatment agent. According to the invention, a preferred hydride may be one that forms a reagent complex between manganese and $LiBH_4$.

The hydride treatment may comprise ball milling of manganese powder with lithium borohydride powder for 4 hours in a planetary ball mill at 150 to 400 rpms. Variations of these conditions may be optimized to appropriately yield an ideal manganese and lithium borohydride complex.

Additionally, the stoichiometric ratio of hydride to Mn may vary from 1/1 to 100/1.

The bismuth may be added in any ether soluble salt form and is preferably added as a salt of a long chain carboxylic acid. In a preferred embodiment, the Bi is added as bismuth neodecanoate. The mole ratio of Bi to Mn may vary from 0.8/1 to 1.2/1. Preferably the ratio of Bi/Mn is from 0.9/1 to 1.1/1 and most preferably, the ratio of Bi/Mn is 1/1. The addition time of the bismuth compound may be varied to optimize and modify the size and properties of the MnBi coating. The coating width may be from 0.5 to 200 nm, preferably 1.0 to 100 nm and most preferably 2 to 20 nm. Preferably the addition time is less than one hour and in a preferred embodiment the addition time is about 20 minutes.

With the addition of the bismuth compound, an organic amine, preferably a primary amine having a carbon chain of from 6 to 12 carbons may optionally be added to the reaction mixture to effect a smaller size of the coated core-shell-shell nanoparticles. The resulting solids may be removed from the reaction mother liquor and washed free of soluble impurities with water.

Figure 2:
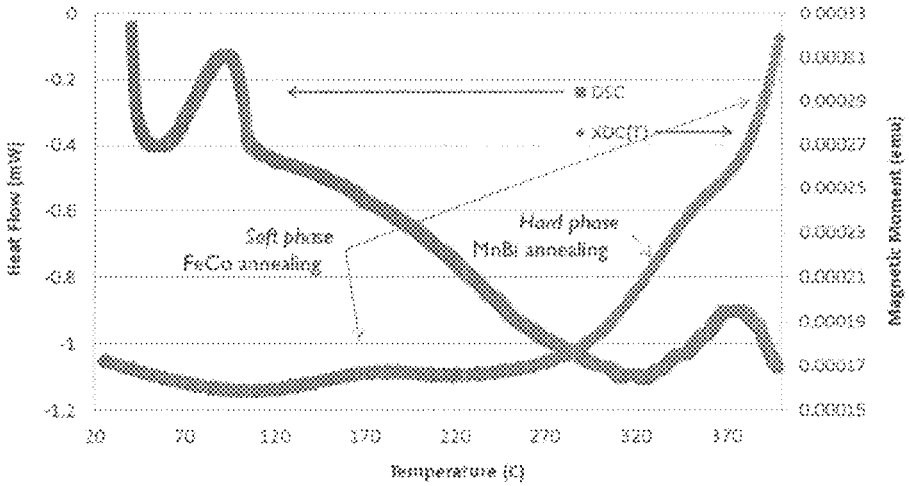
FIG. 2 shows a scan of DSC and M(T) data for the core-shell-shell nanoparticles prepared in the Example.

As indicated in FIG. 2, when the core-shell-shell nanoparticles of the invention are thermally treated in an annealing process, both the soft phase FeCo and hard phase MnBi anneal at temperatures characteristic of FeCo and MnBi respectively.

Having generally described this invention, a further understanding can be obtained by reference to certain specific examples which are provided herein for purposes of illustration only and are not intended to be limiting unless otherwise specified. Skilled artisans will recognize the utility of the devices of the present invention as a battery as well as the general utility of the electrolyte system described herein.

EXAMPLES

I. Preparation of Core-Shell-Shell Iron-Cobalt/Silica/Manganese Bismuth Nanoparticles without Application of Magnetic Field a) 0.489 g sodium hydroxide, 12.892 g tetraoctylammonium bromide, 10.922 g iron dichloride tetrahydrate, and 12.042 g cobalt chloride hexahydrate were dissolved in 250 mL of ethanol and placed under argon. A solution of 12.258 g sodium borohydride dissolved in 450 mL ethanol was then added to the iron cobalt mixture. Upon completion of the borohydride addition the reaction mixture was diluted with 100 mL of water. The product FeCo nanoparticles were then washed with 70% water/30% ethanol.

b) The FeCo nanoparticles were then suspended in a mixture of 625 mL water and 2 mL triethylamine. A solution of 0.5 mL of tetraethylorthosilicate in 390 mL ethanol was then added to the FeCo suspension and the obtained mixture allowed to react for 15 minutes to obtain silica coated nanoparticles. The coated nanoparticles were then washed with ethanol.

c) The silica-coated FeCo nanoparticles (0.27 g) were suspended in 200 mL THF. 0.152 g heptylcyanide, 0.008 g lithium borohydride, and 0.012 g $Mn(LiBH_4)_2$ were added to the FeCo nanoparticle suspension. A solution of 0.082 g of bismuth neodecanoate in 15 mL THF was then added dropwise to the stirring suspension. The product was finally washed with THF.

A TEM image of the prepared core-shell-shell nanoparticles is shown in FIG. 1.

Figure 3:
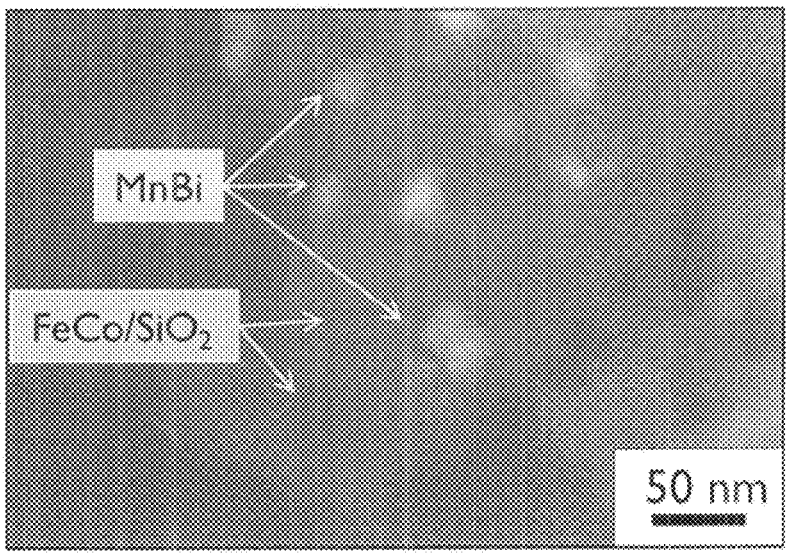
FIG. 3 shows a Z-contrast TEM image of the core-shell-shell nanoparticles prepared in the Example.

The Z-contrast TEM image of FIG. 3 shows how the MnBi phase has an island distribution throughout the FeCo/SiO2.

FIG. 2 shows DSC and M(T) data over temperatures show attributable annealing features for the FeCo and MnBi nanophases.

II. Preparation of Core-Shell-Shell Iron-Cobalt/Silica/Manganese Bismuth Nanoparticles with Application of Magnetic Field Silica-coated FeCo nanoparticles were prepared exactly according to a) and b) of Example I.

Then in stage c) the silica-coated FeCo nanoparticles (0.27 g) were suspended in 200 mL THF. 0.152 g heptylcyanide, 0.008 g lithium borohydride, and 0.012 g $Mn(LiBH_4)_2$ were added to the FeCo nanoparticle suspension. The reaction flask containing the suspension was placed within multiple permanent magnets to apply a magnetic field of 550 Gauss to the mixture. A solution of 0.082 g of bismuth neodecanoate in 15 mL THF was then added dropwise to the stirring suspension within the magnetic field. The resulting product was washed with THF as in Example I.

Figure 4:
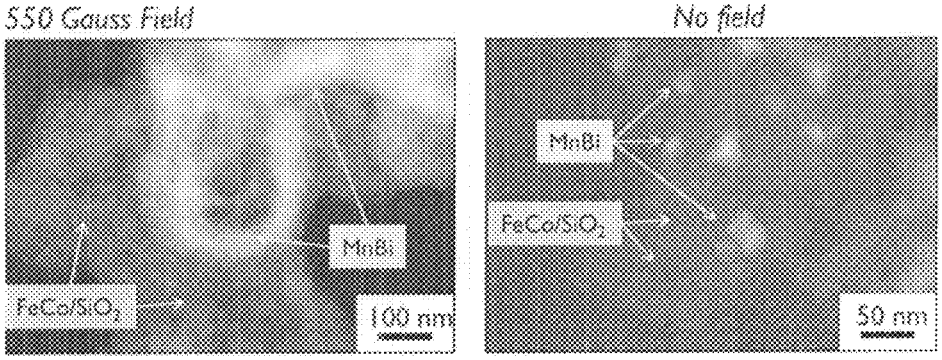
FIG. 4 shows comparison of the Z-contrast TEM image of the core-shell-shell nanoparticles obtained in Example II with the core-shell-core nanoparticles obtained in Example I.

Comparison of the Z-contrast TEM image of the nanoparticles obtained in Example II shown in FIG. 4 with the Z-contrast TEM image of the nanoparticles obtained in Example I showed a dramatic difference in distribution of the MnBi alloy resulted by conducting the MnBi coating within a magnetic field.

The invention claimed is:

1. A method to prepare a core-shell-shell $FeCo/SiO_2/MnBi$ nanoparticle, comprising:

a) co-reducing an iron ion and a cobalt ion from a common solution; and coprecipitating an FeCo alloy nanoparticle;

isolating the FeCo nanoparticle from the reduction mixture;

b) forming a silica coating on the FeCo nanoparticle to obtain a core-shell nanoparticle; and c) forming a MnBi alloy nanocoating on the core-shell nanoparticle by reduction of Bi ions by a Mn borohydride complex with precipitation from a solution as a MnBi alloy onto the silica shell;

wherein the formation of the MnBi alloy nanocoating c) is conducted within a magnetic field of from 50 to 800 Gauss.

2. The method of claim 1 wherein the formation of the MnBi alloy nanocoating c) is conducted in close proximity to a permanent magnet.

3. The method of claim 1 wherein the formation of the MnBi alloy nanocoating c) is conducted within a solenoid.

4. The method of claim 1 wherein the formation of the silica coating comprises a wet chemical synthesis.

5. The method of claim 4 wherein the wet chemical synthesis comprises reaction of tetraethyl orthosilicate and triethylamine and the thickness of the silica coating is controlled by the length of the reaction time.

6. The method of claim 1 wherein a diameter of the FeCo alloy nanoparticle coprecipitated in a) is 100 nm or less.

7. The method of claim 1 wherein a diameter of the FeCo alloy nanoparticle coprecipitated in a) is from 2 nm to 50 nm.

8. The method of claim 1 wherein the formation of a MnBi alloy nanocoating on the core-shell nanoparticle c) comprises:

ball milling a Mn powder with a hydride lithium borohydride reducing agent;

adding a solution of a bismuth salt of a long chain carboxylate and an alkyl amine to the Mn-hydride reducing agent with agitation in an ether solvent; and upon completion of the bismuth salt solution addition, continuing agitation to form the core-shell-shell $FeCo/SiO_2/MnBi$ nanoparticles.

* * * * *